US009334070B2

(12) United States Patent
Till et al.

(10) Patent No.: US 9,334,070 B2
(45) Date of Patent: May 10, 2016

(54) PACKAGE FILLING PLANT, A PACKING DEVICE AND METHOD FOR GROUPING A PACKING FORMATION OF PACKAGES AND CONTAINERS, AND A PACKING DEVICE AND METHOD FOR GROUPING A PACKING FORMATION OF PACKAGES AND CONTAINERS

(75) Inventors: Volker Till, Holfeim am Taunus (DE); Thomas Matheyka, Eppstein (DE)

(73) Assignee: KHS GmbH, Dortmund (DE)

( * ) Notice: Subject to any disclaimer, the term of this patent is extended or adjusted under 35 U.S.C. 154(b) by 1395 days.

(21) Appl. No.: 12/839,672

(22) Filed: Jul. 20, 2010

(65) Prior Publication Data

US 2011/0167771 A1 Jul. 14, 2011

Related U.S. Application Data

(63) Continuation-in-part of application No. PCT/EP2008/010159, filed on Dec. 1, 2008.

(30) Foreign Application Priority Data

Jan. 22, 2008 (DE) ..... 10 2008 005 608

(51) Int. Cl.
*B65B 5/06* (2006.01)
*B65B 5/10* (2006.01)
(Continued)

(52) U.S. Cl.
CPC ..... *B65B 5/106* (2013.01); *B65B 5/061* (2013.01); *B65B 5/108* (2013.01); *B65B 35/50* (2013.01); *B65B 35/56* (2013.01)

(58) Field of Classification Search
CPC ..... B65B 35/50; B65B 5/061; B65B 5/106; B65B 5/108; B65B 35/56; B65B 35/58; B65G 57/28
USPC ..... 53/475, 244, 246, 531, 535, 536, 540, 53/541, 544, 235, 247, 255, 258, 260, 443, 53/446, 447, 473; 414/788.5, 777, 778, 414/780
See application file for complete search history.

(56) References Cited

U.S. PATENT DOCUMENTS

| | | | | |
|---|---|---|---|---|
| 2,938,315 A * | 5/1960 | Voullaire | ..... | 53/475 |
| 3,596,797 A * | 8/1971 | Wallenborn | ..... | 221/10 |
| 3,950,920 A * | 4/1976 | Thomsen et al. | ..... | 53/501 |

(Continued)

FOREIGN PATENT DOCUMENTS

| | | |
|---|---|---|
| CH | 645 310 A | 9/1984 |
| DE | 39 43 395 A1 | 7/1991 |

(Continued)

OTHER PUBLICATIONS

International Search Report PCT/EP2008/010159 and English translation thereof.
German Office Action 10 2008 005 608.1-27.

*Primary Examiner* — Stephen F Gerrity
(74) *Attorney, Agent, or Firm* — Nils H. Ljungman & Associates

(57) ABSTRACT

A packaging arrangement for packaging packages and a method of packaging packages using a packaging arrangement, in which the packages are moved into a receptacle supported on a flexible band. The band is moved to rotate the receptacle to allow at least one additional package to be inserted into the receptacle through another side.

15 Claims, 9 Drawing Sheets

(51) Int. Cl.
*B65B 35/50* (2006.01)
*B65B 35/56* (2006.01)

(56) References Cited

U.S. PATENT DOCUMENTS

| | | | | |
|---|---|---|---|---|
| 4,492,070 | A | 1/1985 | Morse | |
| 4,660,352 | A * | 4/1987 | Deines et al. | 53/438 |
| 4,984,677 | A | 1/1991 | Prakken | |
| 6,494,668 | B2 | 12/2002 | Baur | |
| 6,574,943 | B2 | 6/2003 | Van Dam | |
| 6,974,299 | B2 | 12/2005 | Prakken et al. | |
| 7,096,650 | B2 | 8/2006 | Van Dam | |
| 2007/0119125 | A1 * | 5/2007 | Stenbom | 53/473 |
| 2009/0013641 | A1 | 1/2009 | Prakken | |

FOREIGN PATENT DOCUMENTS

| | | | | |
|---|---|---|---|---|
| DE | 602 04 026 | T2 | 3/2006 | |
| DE | 602 07 534 | T2 | 6/2006 | |
| EP | 0 042 199 | A | 12/1981 | |
| EP | 03 81 256 | A1 | 8/1990 | |
| EP | 09 30 257 | A2 | 7/1999 | |
| EP | 10 44 880 | A1 | 10/2000 | |
| EP | 1847460 | A1 * | 10/2007 | |
| FR | 2 558 453 | A | 7/1985 | |
| GB | 1 601 931 | A | 11/1981 | |
| WO | WO 2006/038796 | A1 | 4/2006 | |
| WO | WO 2007/086725 | | 8/2007 | |
| WO | WO 2009092417 | A1 * | 7/2009 | B65B 5/061 |

* cited by examiner

PACKAGE FILLING PLANT, A PACKING DEVICE AND METHOD FOR GROUPING A PACKING FORMATION OF PACKAGES AND CONTAINERS, AND A PACKING DEVICE AND METHOD FOR GROUPING A PACKING FORMATION OF PACKAGES AND CONTAINERS

CONTINUING APPLICATION DATA

This application is a Continuation-In-Part application of International Patent Application No. PCT/EP2008/010159, filed on Dec. 1, 2008, which claims priority from Federal Republic of Germany Patent Application No. 10 2008 005 608.1, filed on Jan. 22, 2008. International Patent Application No. PCT/EP2008/010159 was pending as of the filing date of this application. The United States was an elected state in International Patent Application No. PCT/EP2008/010159.

BACKGROUND

1. Technical Field

The present application relates to in a package filling plant, a packing device and method for grouping a packing formation of packages and containers, and a packing device and method for grouping a packing formation of packages and containers.

2. Background Information

Background information is for informational purposes only and does not necessarily admit that subsequently mentioned information and publications are prior art.

Some packages and containers with a simple packing plan can be stacked and/or grouped outside the container in which they are to be repackaged and/or shipped, whereupon the group can be slightly compressed and then inserted into a prepared box. The group or the stack of packages is assembled in a grouping device upstream of the opened box which is to be used for the repackaging or shipping, which in the simplest variant is a bottom sheet with two vertical or substantially vertical side walls. This grouping device is generally filled from above, and the packages are inserted in a horizontal or substantially horizontal orientation or are laid in from above. After the desired stack height is reached, this group is inserted into the prepared box using a ram. In the formation of the stack, the ram can also be used if necessary and/or desired as a stop or orientation element, and the stack of packaging units can be positioned by means of the ram during stacking. Then the filled box is once again oriented with the opening facing up, moved away and closed.

For the optimal utilization of the packaging space or for presentation reasons, it is desirable to package the trading units in certain packing patterns, and for example, in addition to the more or less parallel or substantially parallel orientation of the packages in a horizontal or substantially horizontal position, to pre-group these units in the upright position.

To be able to prepare packaging patterns of this type in which very flexible or fragile individual packaging units are not all or substantially all oriented in the same direction but in which individual layers are to be oriented, for example, at a ninety angle with respect to a first layer, some receptacle units for some devices for the preparation of the packing pattern can be provided with two pivoting flaps, on which, in a first step, the packaging units to be oriented sideways are placed lying down in a first step. Then the flaps are closed and this packing group is pushed as a unit into the prepared box.

A device of this type severely limits the type of potential packaging patterns that can be achieved and cannot reliably prevent, restrict, and/or minimize the slipping of individual packaging units, for example those that are on top when the flaps are closed. Sliding of the individual packages could then lead to excessive pressure on the contents and in the worst case could result in damage to the packaging unit itself.

OBJECT OR OBJECTS

An object of the present application is therefore to make available a packaging and grouping device which can be used to achieve the broadest possible spectrum of packing patterns and to minimize the likelihood of damage.

SUMMARY

The present application teaches that this object can be accomplished by the packing and grouping device for any desired packaging units, whereby in this case "packaging unit" means in one possible embodiment sacks, trays, bags, cook-and-serve trays, etc. The packing and grouping unit is also suitable for cuboid boxes. The device comprises at least one feed line, at least one grouping unit and at least one filling unit. The special characteristic is that the grouping unit comprises a receptacle unit for the formation of layers in which at least one side wall is formed by at least one band or band-like element.

The receptacle element is further mounted so that it can rotate to turn or rearrange the packaging units that have been placed in it, whereby the side wall and/or side walls formed by the at least one band or band-like element are variable in terms of surface area and/or position. It is possible to turn the receptacle unit after the insertion of a first number of packaging units, to orient an additional number of packaging units, e.g. at a ninety degree angle with respect to the first layer. For that purpose, the first number of packaging units and each additional number can be inserted with the same feed element, e.g. a vacuum gripper, which orients the packaging units all or substantially all essentially in a horizontal or substantially horizontal position and inserts them from above into the receptacle element.

In at least one possible embodiment of the present application, the suitable lateral support of the packaging units that have already been inserted is always or substantially always essentially guaranteed or promoted, and that during rotation, the required and/or desired opening on the top is always or substantially always produced automatically, without having to move and vary large elements such as flaps or supports.

In one embodiment of the present application, the basic framework of the receptacle unit is a grid that is formed by rods or beams, similar to a cage or a simple cell. Because generally the packaging units are moved relative to one another only or substantially only once or rotated as a group, in one improved variant, two side surfaces of the receptacle element that are directly opposite each other are realized in the form of rigid walls, wall grids or similar structures.

To achieve an even more extensive flexibility or to fully utilize the allowable pressures, in one possible embodiment of the present application, the size of the receptacle element is variable in at least one direction. By closing the lateral openings with flexible or adjustable bands, minimal constructive measures are required and/or desired on the rest of the device. If partly rigid lateral surfaces are provided in some cases, they must be or should be designed as variable elements. In one possible embodiment of the present application, the side walls may be designed as walls made of slats, layers that overlap each other like bricks or tiles or in a similar pattern.

In one possible embodiment of the present application, the grouping can be done very loosely and then the desired density or pressure can be set without destabilizing the packing pattern. To achieve this variation in size or pressure with as little vibration or shaking as possible, it is possible to provide at least one motorized drive in the framework or base grid of the receptacle unit and to construct the base grid or base body so that it is telescoping at least in parts.

The bands are secured or fastened on at least one end outside the receptacle unit. In one possible embodiment of the present application, both ends of the band or the bands are secured. The bands thereby have a tensioning device on at least one end of the band. In one embodiment, the bands can be wound up on storage rolls or are mounted so that they are movable. This process is motor-driven. As a result of this arrangement, it is possible to accelerate the band back and forth simultaneously or substantially simultaneously with the rotational movement of the receptacle element, as a result of which the friction between the band surface on the one hand and between the receptacle element and the inserted packages on the other side is reduced.

These storage rollers 19 are motor driven. The closing band 15 runs on both sides of the base body 14 by means of tensioning and guide elements 20, which comprise stationary base rollers 21 and a guide roll 23 that is pivotably mounted on a lever arm 22.

For the further optimization of the path of the band and the band movement, at least one tensioning and guide element is provided which comprises a stationary base roll and a guide roll which is pivotably mounted on a lever arm, by means of which the at least one band or band-like element is guided. This guide roller or guide roll can be motor driven so that it can be moved at a right angle to the direction of the band in at least one direction. In this manner it is possible to always or substantially always close the receptacle unit optimally and to prevent, restrict, and/or minimize the packages that have been inserted from falling out.

The present application also comprises a very compact variant of the packing and grouping device, in which the grouping unit comprises a pusher device which is mounted and can be driven so that it can execute movements in the axial direction and rotational movements around the axis, whereby the receptacle unit or parts of the receptacle unit are fastened to the head end of the pusher device and can be rotated by it. For this purpose a frame can be attached to the head end of the pusher device, to which the rods or beams that guide the bands are fastened.

The present application also comprises a packing and grouping method, in one possible embodiment for non-cuboid packaging units such as sacks, boxes, trays, bags, cook-and-serve trays, etc. in which the packing and grouping device is used in one of the above mentioned embodiments.

At least the following steps must be or should be carried out:

a) Feed of the packaging units b) Transfer of the packaging units from the feed into the receptacle unit c) Rotation of the receptacle unit by an angle $\alpha$ d) Transfer of additional packaging units into the receptacle unit e) Transfer of the packaging group formed into the receptacle unit into the repackaging or shipment packaging.

In one variant, after Step d), the receptacle unit can be rotated back into the starting position around the angle $-\alpha$ or rotated further in the direction of the first rotation, and then Step e) can be executed.

It is thereby possible to adjust the tension of the at least one band during Step c). In one possible embodiment of the present application, during Step c), the at least one band is moved in the direction of rotation. The band must or should thereby be driven at a speed such that there is no difference or only or substantially only a minimal difference between the moving band and with the elements of the receptacle unit that are in contact with it.

The present application relates to a packing and grouping device for packaging units, in one possible embodiment sacks, boxes, trays, bags, cook-and-serve trays, etc. and comprises at least one feed line, at least one grouping unit and at least one filling unit, whereby the grouping unit comprises a receptacle element for the formation of layers of packaging units in which at least one side wall is formed by at least one band or band-like element and the receptacle element is mounted so that it can rotate to turn or rearrange the packing units, whereby the surface area and/or position of the side wall and/or side walls formed by the at least one band or band-like element is or are variable.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Possible embodiments of the present application are illustrated in the accompanying figures.

DESCRIPTION OF EMBODIMENT OR EMBODIMENTS

Figure 1:
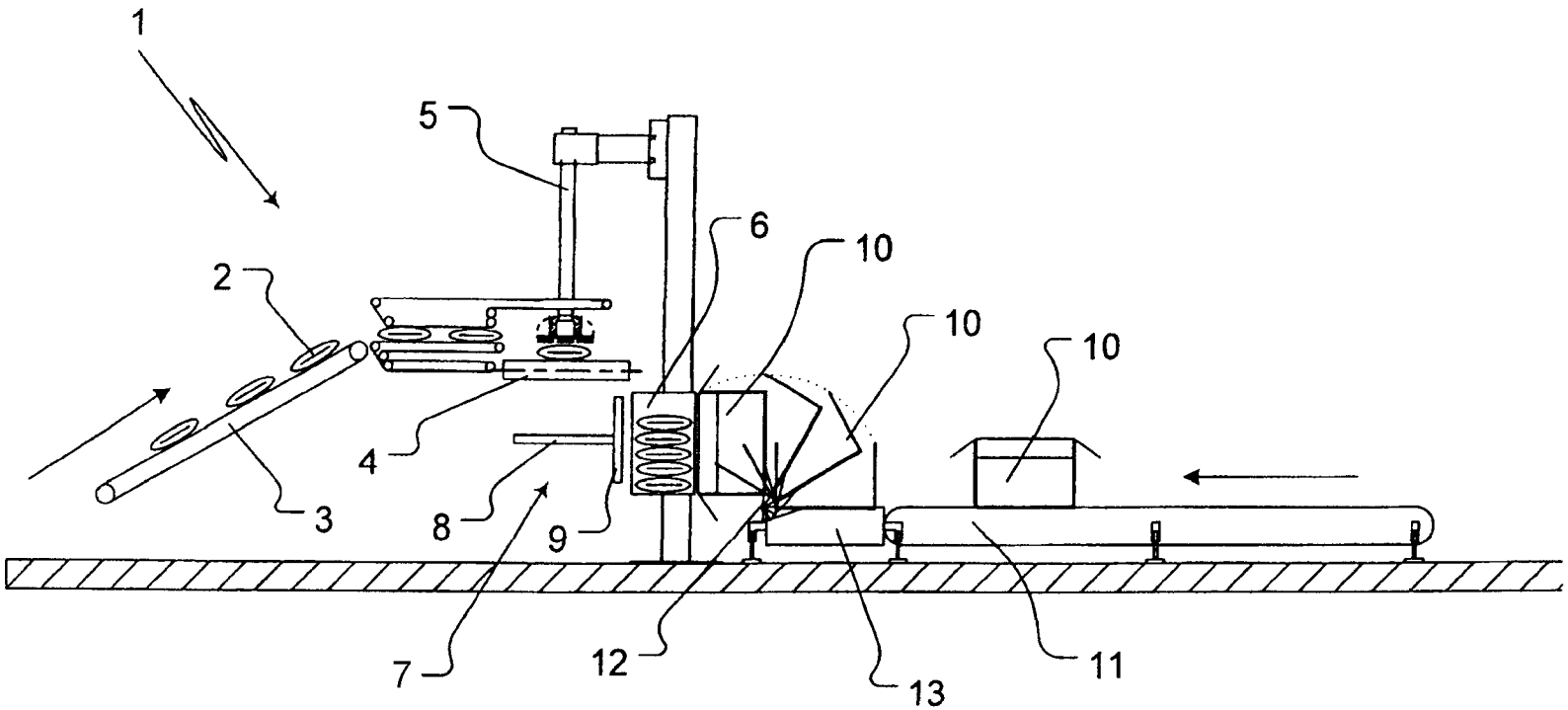
FIG. 1 is an overview of the packing and grouping device according to the present application.

FIG. 1 shows the packing and grouping device 1 according to the present application in an overall view. The individual items or individual packaging units, which are referred to below as packaging units 2, are transported by means of a feed conveyor 3 to a pre-grouping unit 4. In the pre-grouping unit 4, a plurality of packaging units 2 are positioned in a single layer at the desired distance from one another and are then lifted by the vacuum gripper 5, which in this case is a robot with an articulated arm, and placed into the receptacle unit 6.

The details of the receptacle unit 6 are illustrated more clearly in FIG. 2. Facing the receptacle unit 6 is a pusher device 7 which comprises a push rod 8, a push plate 9 and a motor drive (not shown), which is used to insert the packing units 2 arranged in the final group into the open box 10.

The empty boxes 10 are moved by means of a conveyor belt 11 to a tipping device 12 and positioned opposite the receptacle unit 6. In the illustrated example the open boxes are transported by means of the conveyor belt 11.

After the insertion of the grouped packages by means of the pusher device 7, the box 10 is tipped back and removed by means of the conveyor belt 13 at a ninety degree angle with respect to the conveyor belt 11. A device and method of this type are known.

FIGS. 2A, 2B, 2C, 2D, and 2E show the receptacle unit 6 according to the present application in the five steps of the method during the loading process, each figure illustrating one step.

Figure 2A:
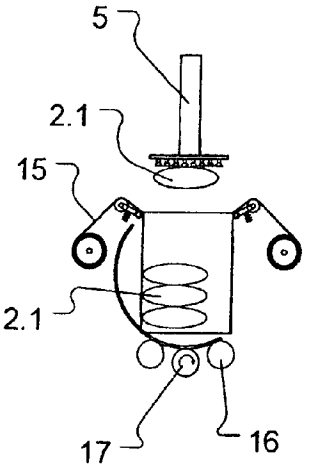
FIGS. 2A, 2B, 2C, 2D, and 2E show, in the form of a schematic side view, the receptacle unit with the corresponding band arrangement and the band suspension.
Figure 2B:
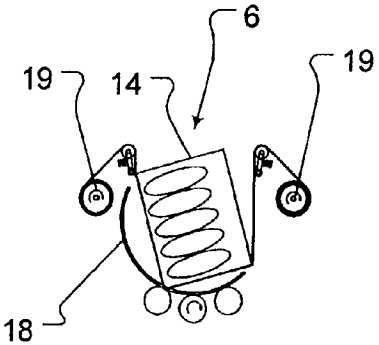

As illustrated in FIG. 2B, the receptacle unit 6 comprises a base body 14, the constructive features of which are not illustrated in greater detail, a drive unit and a band or closing band 15. The base body 14 is a vertically or substantially vertically upright tubular rectangle, each of the four corners of which has a rod that points vertically or substantially vertically toward the open box. In one possible embodiment of the present application, this base body or base cage 14 has no barriers in the pushing direction of the pusher device 7. The drive unit is also illustrated schematically and comprises two bearing rollers 16 and a motor drive 17 which acts on a driver element 18 which is connected with the base body 14 of the receptacle unit 6.

In one possible embodiment of the present application, the base body 14 may be connected to the driver element 18. The driver element 18 may comprise a recess or a hollowed out area, into which the corner of the base body 14 fits into. The base body 14 may be held by the recess of the driver element 18 to permit rotation of the base body 14 by the driver element 18.

The closing band 15 in FIG. 2A, which is the initial filling process with the packages 2.1, surrounds the base body 14 from three sides. The ends of the closing band 15 are each secured and rolled up on a storage roll 19. These storage rolls are motor-driven. The closing band 15 runs on both sides of the base body 14 by means of tensioning and guide elements 20, each of which comprises a stationary base roll 21 and a guide roll 23 which is pivotably mounted on a lever arm 22.

In the illustrated example, the guide rolls 23 are held by means of spring elements 24 which are engaged on the lever arms 22 against the closing band 15, and the closing band 15 is therefore held under tension and in position.

The process steps are illustrated as follows:

As shown in FIG. 2A, the vacuum gripper 5 places the packages 2.1 from above in layers in a first orientation into the base body 14 of the receptacle unit 6. The base body 14 is surrounded by the closing band 15 on one short side, which in this case is the bottom, and the two long side surfaces. The storage rolls 19 are not driven.

As shown in FIG. 2B, the base body 14 begins to rotate after the first batch of packages has been fully loaded. Driven by the drive unit 15, the base body 14 is rotated counterclockwise. The closing band 15 is thereby unrolled from the left storage roll 19 and rolled up on the right storage roll 19.

Figure 2C:
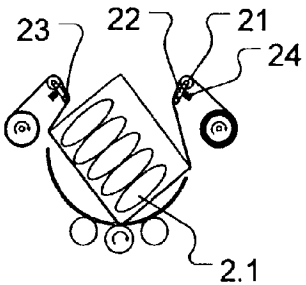
Figure 2D:
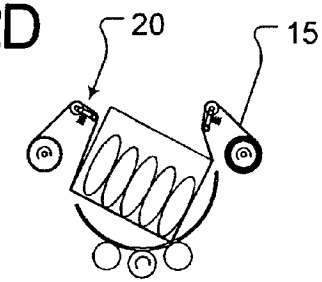

In FIGS. 2C and 2D, the movement is continued, whereby what was formerly the right side wall is released and the short surface that was formerly the bottom becomes the new side surface. Throughout this process, the closing band 15 is optimally guided by contact with the guide rolls 23.

Figure 2E:
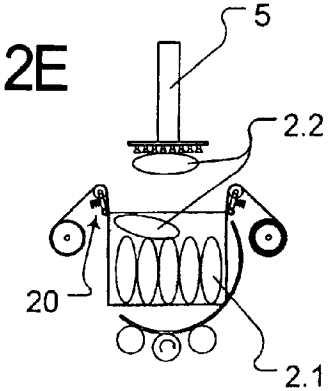

FIG. 2E illustrates the second filling phase, in which the packages 2.1 are now standing upright, and the packages 2.2 are oriented crosswise on the packages 2.1. The vacuum gripper 5 places the packages 2.2 into the receptacle unit 6 vertically or substantially vertically from above.

Figure 3:
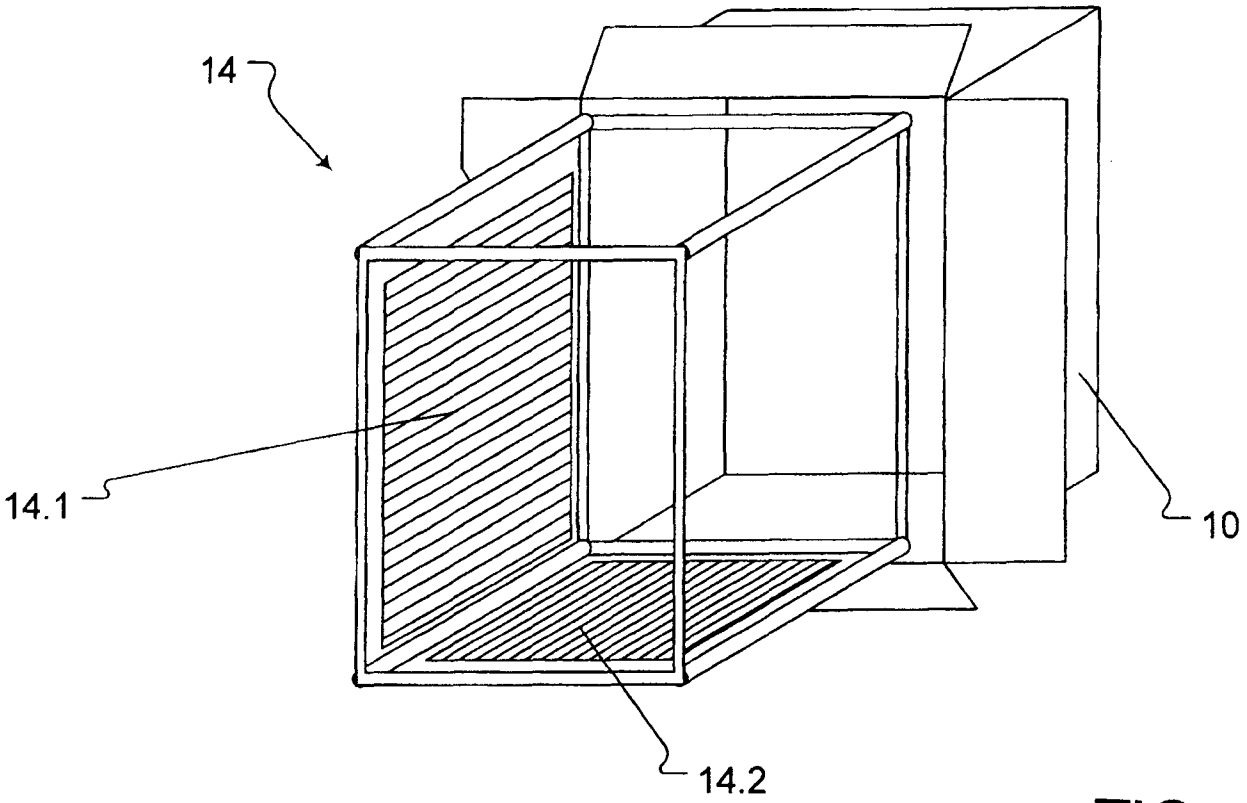
FIGS. 3 and 3A show, in a three-dimensional illustration, the basic construction and body of the receptacle unit, with and without side walls, respectively.
Figure 3A:
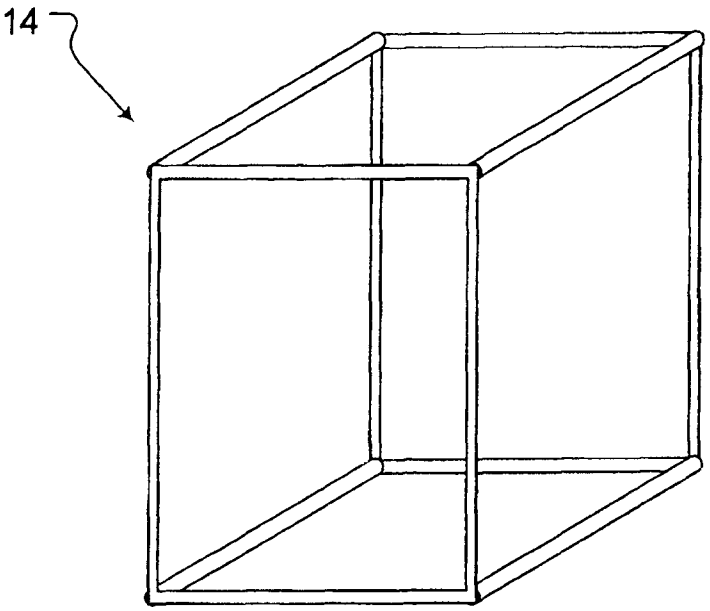

FIG. 3 shows a special base body 14 in which two of the wall elements 14.1 and 14.2 are rigid plates. This embodiment is possibly used when ninety degree rotations are planned. FIG. 3A shows another embodiment of the base body 14 in which the wall elements 14.1 and 14.2 are omitted.

FIGS. 4A, 4B, 4C, 4D, and 4E show the receptacle unit 6 according to the present application in the five steps of the method during the loading process, each figure illustrating one step. FIGS. 4A, 4B, 4C, 4D, and 4E have similar views to those of FIGS. 2A, 2B, 2C, 2D, and 2E, with additional features.

Figure 4A:
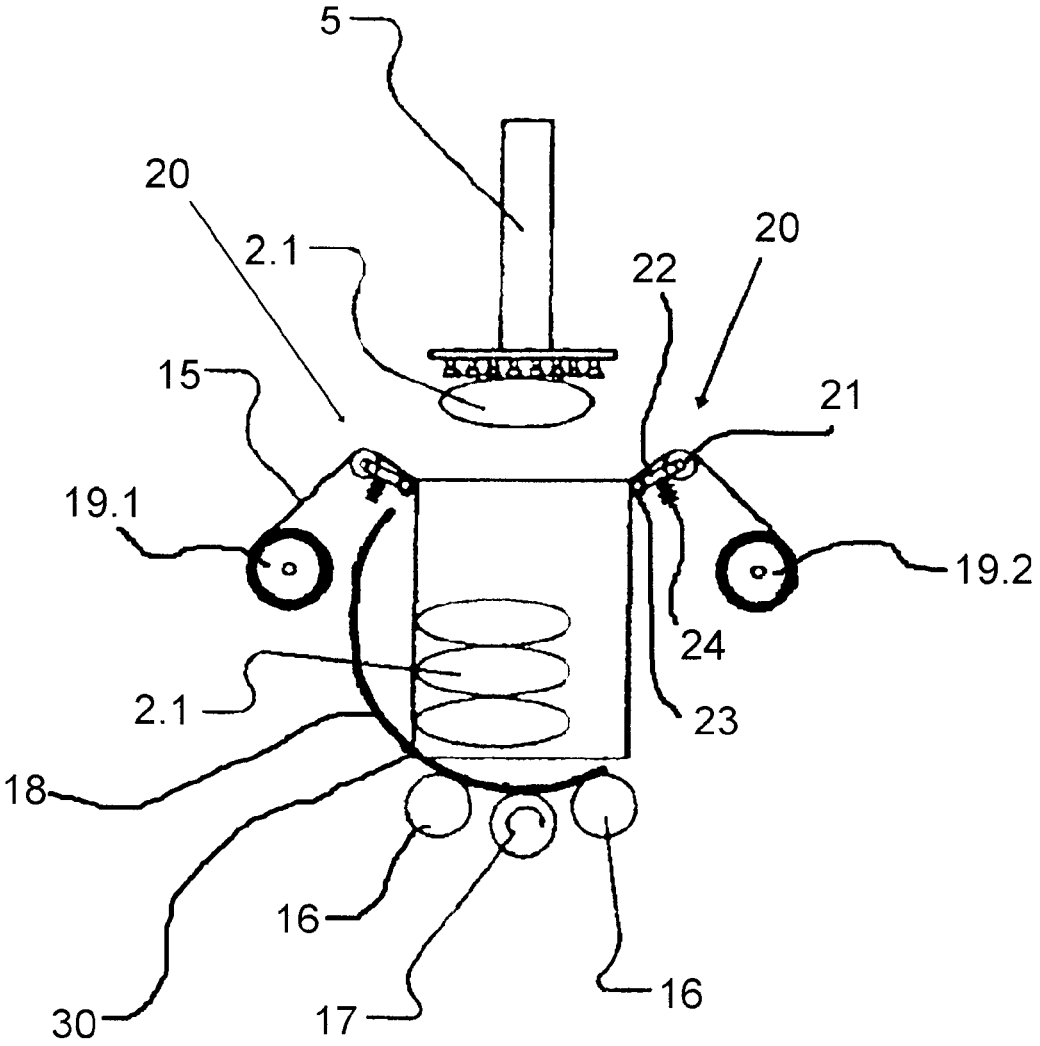
FIGS. 4A, 4B, 4C, 4D, and 4E show, in the form of a schematic side view, the receptacle unit with the corresponding band arrangement and the band suspension.

FIG. 4A shows the vacuum gripper 5 placing packages 2.1 from above in layers in a first orientation into the base body 14 of the receptacle unit 6. The base body 14 is surrounded by the closing band 15 on one short side, which in this case is the bottom, and the two long side surfaces. The left storage roll 19.1 and the right storage roll 19.2 are not driven during this step. The motor drive 17, the bearing rollers 16, and the driver element 18 are not rotating and/or moving. The guide elements 20 each comprise a stationary base roll 21, a lever arm 22, a guide roll 23, and a spring element 24. As seen in FIG. 4A, the guide rolls 23 are held by means of spring elements 24, which are engaged on the lever arms 22 against the closing band 15, and the closing band 15 is therefore held under tension and in position. The connection 30 between the driver element 18 and the base body 14 is also illustrated. In one possible embodiment of the present application, the connection 30 may be a recess 30 of the driver element 18, into which the corner of the base body 14 fits, to permit rotation of the base body 14 by the controlled movement and/or rotation of the driver element 18 by the drive motor 17. In another possible embodiment of the present application, the connection 30 may be a weld 30, which connects the base body 14 to the driver element 18.

Figure 4B:
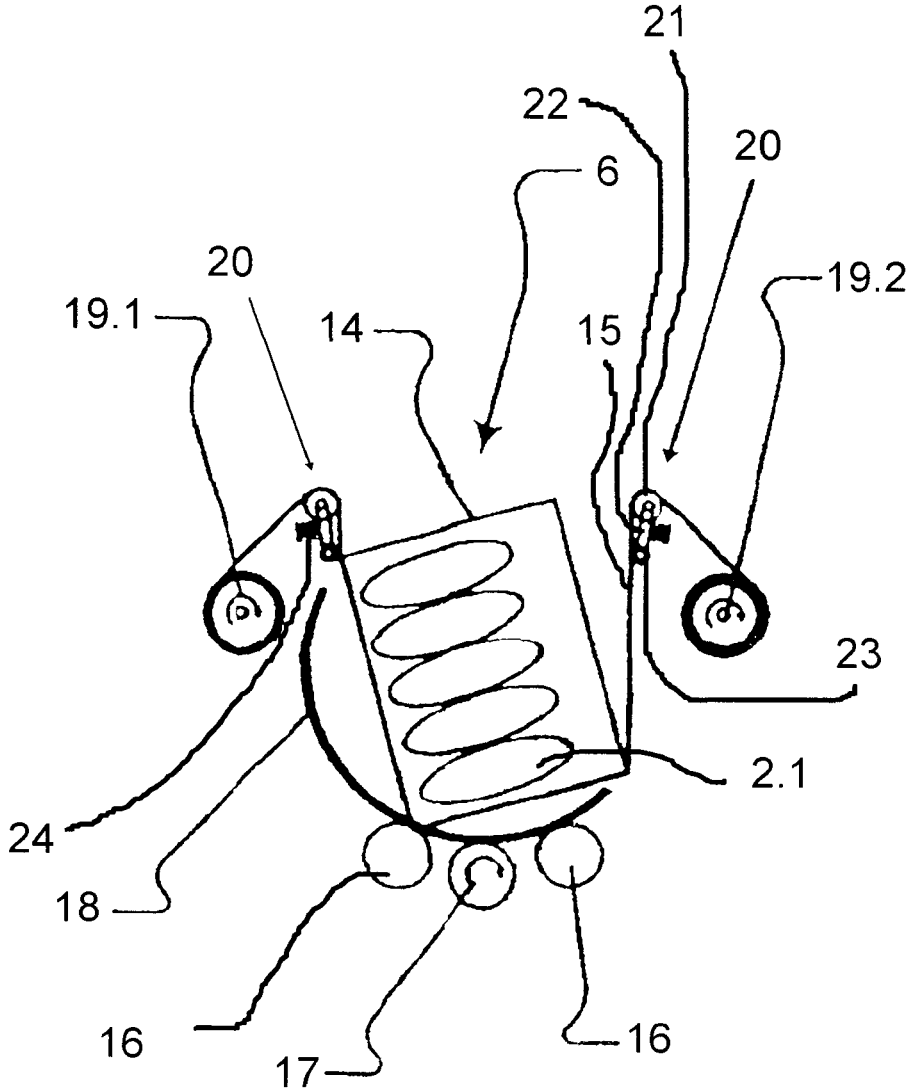

FIG. 4B shows the next step in the process. As shown in FIG. 4B, the base body 14 begins to rotate after the first batch of packages has been loaded into the base body 14 by the vacuum gripper 5. Driven by the drive motor 17, the driver element 18 and the base body 14 are rotated counterclockwise. The bearing rollers 16 may help with the rotation of the driver element 18 and base body 14. The closing band 15 is unrolled from the left storage roll 19.1 and rolled up on the right storage roll 19.2 as the driver element 18 and base body 14 of the receptacle 6 rotates in a counterclockwise direction. In one possible embodiment of the present application, a controller may control the movement and/or rotation of the drive motor 17, the left storage roll 19.1, and the right storage roll 19.2. In one possible embodiment, the controller may be a computer.

Figure 4C:
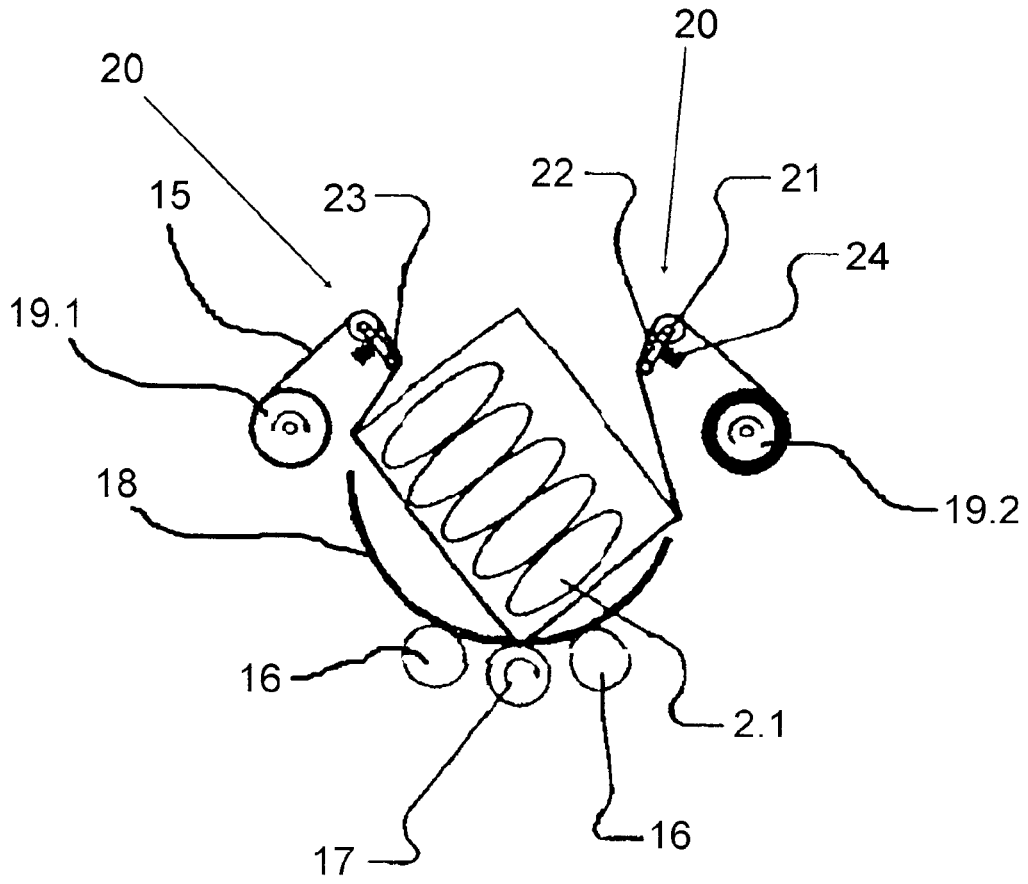
Figure 4D:
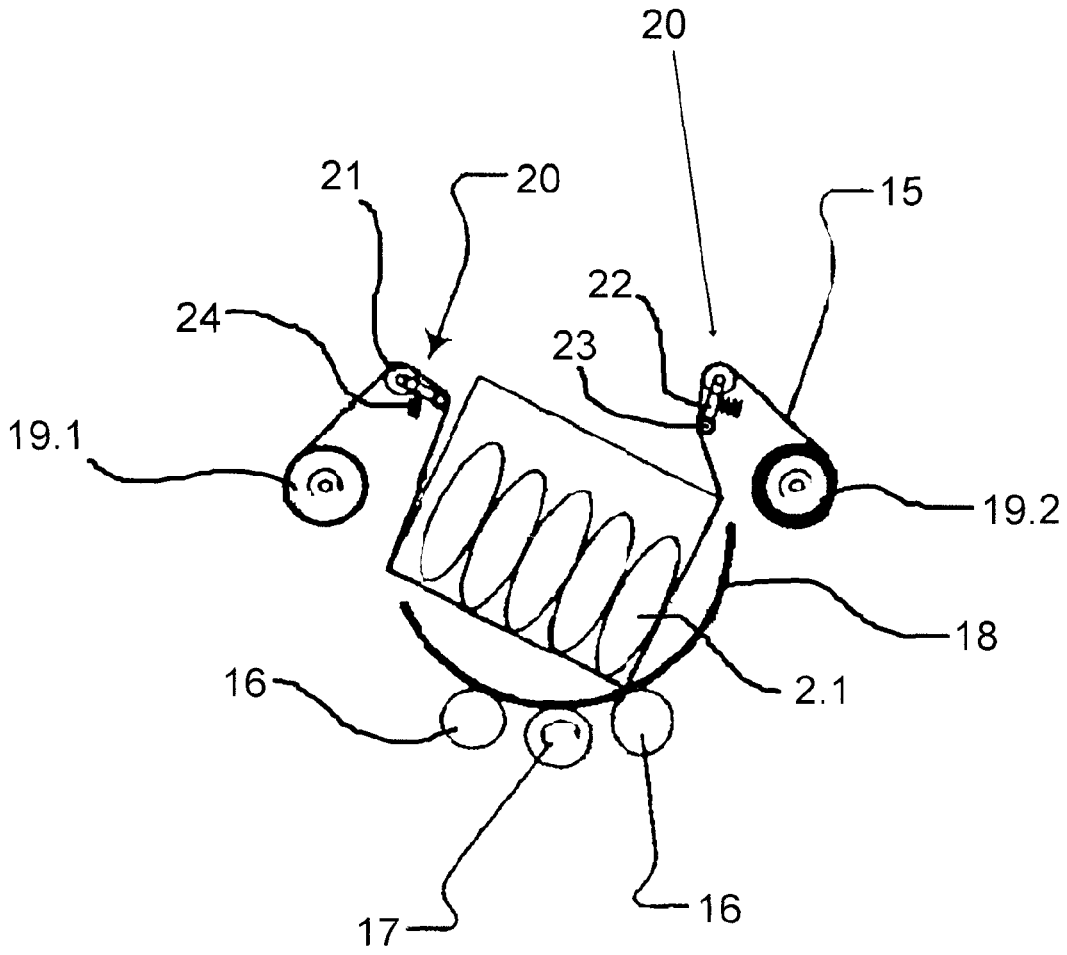

In FIGS. 4C and 4D, the rotational movement of the driver element 18 and the base body 14 is continued, whereby what was formerly the right side wall is released and the short surface that was formerly the bottom becomes the new side surface. Throughout this process, the closing band 15 may be guided by contact with the guide elements 20. The drive motor 17 may continue to drive and rotate the driver element 18 and base body 14 as the motorized left storage roll 19.1 and motorized right storage roll 19.2 move the closing band 15, unrolling it from the left storage band 19.1 and onto the right storage band 19.2.

Figure 4E:
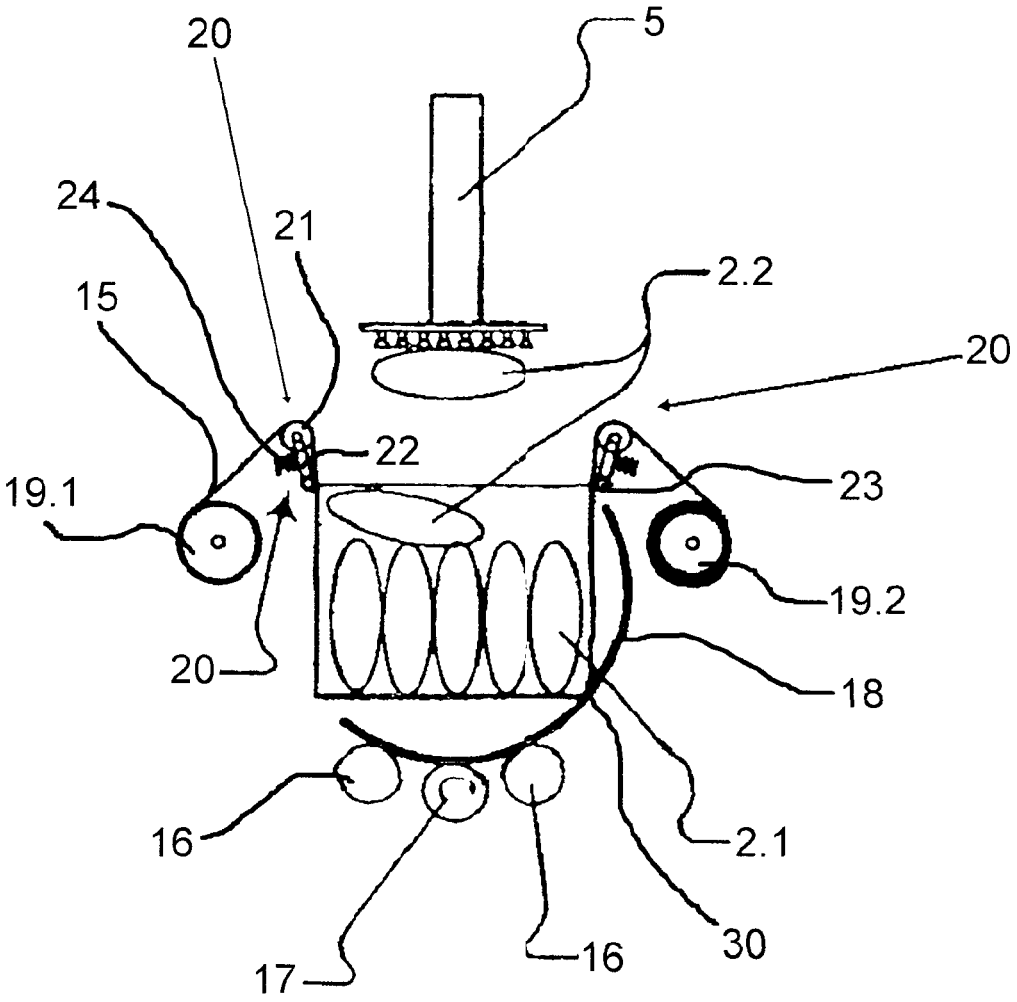

FIG. 4E illustrates the second filling phase, in which the packages 2.1 in the first orientation in the receptacle unit 6 are now standing upright, and the packages 2.2 are oriented crosswise, in a second orientation, on the packages 2.1. The vacuum gripper 5 places the packages 2.2 into the receptacle unit 6 vertically or substantially vertically from above.

In one possible embodiment of the present application, the method may include introducing breakable objects packaged in bags (for examples, chips, etc) into a box, whereby the bags are introduced in at least two layers with different orientations. For this purpose, the orientation station may be turned around after the first layer has been laid down, so that the next layers of bags can be introduced with little or no or substantially no compression. In one possible embodiment, the individual bag does not need to be turned or shoved in, but the first layer of bags that is already supporting itself is turned as a group and the next layer can be placed loosely on top of it with optimum accessibility for the lifting mechanisms (in one embodiment, a suction or vacuum grabber 5).

The present application relates to a packaging and grouping device for packaging units 2, in one possible embodiment pouches, boxes, trays, bags, menu trays, and the like, and comprises at least one feeding path, at least one grouping unit, and at least one filling unit, wherein the grouping unit comprises a receiving element 6 for forming layers of packaging units 2, wherein at least one side wall is formed by at least one band 15 or a band-like element, and the receiving element 6 is rotatably supported for turning or shifting the inserted packaging units 2, wherein the side wall and/or the side walls formed by the at least one band 15 or band-like element can be varied with respect to the surface and/or position.

One feature or aspect of an embodiment is believed at the time of the filing of this patent application to possibly reside broadly in a packing and grouping device for packing units, in one possible embodiment sacks, boxes, trays, bags, cook-and-serve trays etc., comprising at least one feed line, at least one grouping unit and at least one filling unit, wherein the grouping unit comprises a receptacle element for the formation of layers in which at least one side wall is formed by at least one band or band-like element and the receptacle element is mounted rotationally to turn or rearrange the inserted packaging units, whereby the side wall and/or side wall formed by at least one band or band-like element is variable in terms of surface area and/or position.

Another feature or aspect of an embodiment is believed at the time of the filing of this patent application to possibly reside broadly in the packing and grouping device, wherein the receptacle element has a cage or partial cage formed from bars or beams as a base frame.

Yet another feature or aspect of an embodiment is believed at the time of the filing of this patent application to possibly reside broadly in the packing and grouping device, wherein two side surfaces of the receptacle element directly adjacent to one another are rigid walls, wall grids or similar structures.

Still another feature or aspect of an embodiment is believed at the time of the filing of this patent application to possibly reside broadly in the packing and grouping device, wherein the receptacle element is variable in terms of its size in at least one direction, whereby in the case of partly rigid side surfaces, these side surfaces are in the form of variable elements that can expand in at least one direction, in one possible embodiment in the form of slat walls, layers that overlap one another like bricks or tiles, etc.

A further feature or aspect of an embodiment is believed at the time of the filing of this patent application to possibly reside broadly in the packing and grouping device, wherein at least one drive, in on possible embodiment a motor or hydro-pneumatic drive, is provided to vary the dimensions, in the framework or base grid of the receptacle unit.

Another feature or aspect of an embodiment is believed at the time of the filing of this patent application to possibly reside broadly in the packing and grouping device, wherein the bands are secured on at least one end outside the receptacle unit.

Yet another feature or aspect of an embodiment is believed at the time of the filing of this patent application to possibly reside broadly in the packing and grouping unit, wherein the bands have a tensioning device and/or band guidance device on at least one end of the band.

Still another feature or aspect of an embodiment is believed at the time of the filing of this patent application to possibly reside broadly in the packing and grouping device, wherein the bands are mounted and driven so that they can be wound up or displaced so that they can be accelerated back and forth simultaneously or substantially simultaneously with the rotational movement of the receptacle element.

A further feature or aspect of an embodiment is believed at the time of the filing of this patent application to possibly reside broadly in the packing and grouping unit, wherein at least one guide roller or guide roll is provided, by means of which the at least one band or band-like element is guided.

Another feature or aspect of an embodiment is believed at the time of the filing of this patent application to possibly reside broadly in the packing and grouping device, wherein the at least one guide roll or guide roller is motor driven so that the band can be displaced in at least one direction at a ninety degree angle to the band direction.

Yet another feature or aspect of an embodiment is believed at the time of the filing of this patent application to possibly reside broadly in the packing and grouping device, wherein the grouping unit comprises a pusher device which is mounted and can be driven so that it can execute movements in the axial direction and can rotate around the axis, whereby the receptacle unit or parts of the receptacle unit are fastened to the pusher device and can be rotated by it.

Still another feature or aspect of an embodiment is believed at the time of the filing of this patent application to possibly reside broadly in a packing and grouping device for packing units, in one possible embodiment sacks, boxes, trays, bags, cook-and-serve trays etc., wherein a device according to the present application is used.

A further another feature or aspect of an embodiment is believed at the time of the filing of this patent application to possibly reside broadly in a packing and grouping method for packing units, in one possible embodiment sacks, boxes, trays, bags, cook-and-serve trays etc., wherein a device according to the present application is used.

One feature or aspect of an embodiment is believed at the time of the filing of this patent application to possibly reside broadly in the packing and grouping method, wherein at least the following steps are carried out:

a) Feed of the packaging units b) Transfer of the packaging units from the feed into the receptacle unit c) Rotation of the receptacle unit by an angle $\alpha$ d) Transfer of additional packaging units into the receptacle unit e) Transfer of the packaging group formed into the receptacle unit into the repackaging or shipment packaging.

Another feature or aspect of an embodiment is believed at the time of the filing of this patent application to possibly reside broadly in the packing and grouping method, wherein after Step d), the receptacle unit is rotated back into the starting position by the angle $-\alpha$ or is rotated farther in the direction of the first rotation, and then Step e) is executed.

Yet another feature or aspect of an embodiment is believed at the time of the filing of this patent application to possibly reside broadly in the packing and grouping unit, wherein the tension of the at least one band is adjusted during Step c).

Still another feature or aspect of an embodiment is believed at the time of the filing of this patent application to possibly reside broadly in the packing and grouping method, wherein the tension of the at least one band is adjusted during Step c).

A further feature or aspect of an embodiment is believed at the time of the filing of this patent application to possibly reside broadly in the packing and grouping method, wherein during Step c) the at least one band is moved in the direction of rotation, in one possible embodiment at a speed such that there is no speed differential or only or substantially only a minimal speed differential between the moving band and the elements of the receptacle unit that are in contact with it.

One feature or aspect of an embodiment is believed at the time of the filing of this patent application to possibly reside broadly in, in a container filling plant, packing and grouping apparatus for packaging units, comprising sacks, boxes, trays, bags, cook-and-serve trays and the like, said packing and grouping apparatus comprising at least one feed line, at least one grouping unit and at least one filling unit, wherein the grouping unit comprises a receptacle element for the formation of layers in which at least one side wall is formed by at least one band or band-like element and the receptacle element is mounted rotationally to turn or rearrange the inserted packaging units, whereby the side wall and/or side wall formed by at least one band or band-like element is variable in terms of surface area and/or position.

Another feature or aspect of an embodiment is believed at the time of the filing of this patent application to possibly reside broadly in packing and grouping apparatus, wherein the receptacle element has a cage or partial cage formed from bars or beams as a base frame.

Yet another feature or aspect of an embodiment is believed at the time of the filing of this patent application to possibly reside broadly in packing and grouping apparatus, wherein two side surfaces of the receptacle element directly adjacent to one another are rigid walls, wall grids or similar structures.

Still another feature or aspect of an embodiment is believed at the time of the filing of this patent application to possibly reside broadly in packing and grouping apparatus wherein: the receptacle element is variable in terms of its size in at least one direction, whereby in the case of partly rigid side surfaces, these side surfaces are in the form of variable elements that can expand in at least one direction, comprising slat walls, layers that overlap one another like bricks or tiles, etc; at least one drive, comprising a motor or hydro-pneumatic drive, is provided to vary the dimensions, in the framework or base grid of the receptacle unit; the bands are secured on at least one end outside the receptacle unit; the bands have a tensioning device and/or band guidance device on at least one end of the band; the bands are mounted and driven so that they can be wound up or displaced so that they can be accelerated back and forth simultaneously with the rotational movement of the receptacle element; at least one guide roller or guide roll is provided, by means of which the at least one band or band-like element is guided; the at least one guide roll or guide roller is motor driven so that the band can be displaced in at least one direction at a 90° angle to the band direction; the grouping unit comprises a pusher device which is mounted and can be driven so that it can execute movements in the axial direction and can rotate around the axis, whereby the receptacle unit or parts of the receptacle unit are fastened to the pusher device and can be rotated by it; the at least one feed line is configured to feed packaging units; the packing and grouping apparatus is configured to transfer packaging units from the at least one feed line into the receptacle unit; the receptacle unit is configured to rotate by an angle $\alpha$; the packing and grouping apparatus is configured to transfer additional packaging units from the at least one feed line into the receptacle unit; the packing and grouping apparatus is configured to transfer the packaging group formed into the receptacle unit into the repackaging or shipment packaging; and the receptacle unit is further configured to rotate back into the starting position by the angle $-\alpha$ or is configured to rotate farther in the direction of the first rotation prior to transferring the packaging group formed into the receptacle unit into the repackaging or shipment packaging.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The following patents, patent applications or patent publications, are hereby incorporated by reference as if set forth in their entirety herein except for the exceptions indicated herein: DE 602 04 026 T2, having the English translation of the German title "CONVEYOR ASSEMBLY FOR PACKAGINGS, AND METHOD FOR DELIVERY OF A PACK," published on Mar. 2, 2006; DE 602 07 534 T2, having the English translation of the German title "METHOD AND DEVICE FOR PACKING ARTICLES," published on Jun. 14, 2006; WO 2006/038796 A1, having the title "DEVICE FOR FILLING A CARTON," published on Apr. 13, 2006; and WO 2007/086725, having the title "CASSETTE FOR RECEIVING FLEXIBLE PACKS, AS WELL AS METHOD FOR THE FORMATION OF A GROUP OF PACKS," published on Aug. 2, 2007.

All of the patents, patent applications or patent publications, except for the exceptions indicated herein, which were cited in the International Search Report dated Mar. 17, 2009, and/or cited elsewhere are hereby incorporated by reference as if set forth in their entirety herein, as follows: DE 39 43 395, having the following English translation of the German title "Carrier for pourable goods—consists of bag packer with two collectors each with delivery plate, storage plate, guide shaft, and compressor," published on Jul. 4, 1991; EP 0 042 199, having the title "Packing machine," published on Dec. 23, 1981; U.S. Pat. No. 4,492,070, having the title "CASE LOADING APPARATUS AND METHOD," published on Jan. 8, 1985; FR 2 558 453, having the following English translation of the French title "Device for the constant-level loading and unloading of a container with a movable plate," published on Jul. 26, 1985; and GB 1 601 931, having the title "PACKAGING APPARATUS," published on Nov. 4, 1981.

All of the patents, patent applications or patent publications, except for the exceptions indicated herein, which were cited in the German Office Action dated Oct. 9, 2009, and/or cited elsewhere are hereby incorporated by reference as if set forth in their entirety herein, as follows: EP 1 044 880, having the title "Device for placing sacks filled with a product in a box," published on Oct. 18, 2000; EP 0 930 257, having the following English translation of the German title "Method and device for piling non-packed slices of processed cheese," published on Jul. 21, 1999; EP 0 381 256, having the title "Device for transferring objects, such as filled bags, from a conveyor to a collection device, such as a box, placed below said conveyor," published on Aug. 8, 1990; and CH 645 310, having the following English translation of the German title "Apparatus for the packaging of a number of flat bags," published on Sep. 28, 1984.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2008 005 608.1, filed on Jan. 22, 2008, having inventors Volker TILL and Thomas MATHEYKA, and DE-OS 10 2008 005 608.1 and DE-PS 10 2008 005 608.1, and International Application No. PCT/EP2008/010159, filed on Dec. 1, 2008, having WIPO Publication No. WO 2009/092417 and inventors Volker TILL and Thomas MATHEYKA, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, except for the exceptions indicated herein, are hereby incorporated by reference as if set forth in their entirety herein.

The purpose of incorporating the corresponding foreign equivalent patent application(s), that is, PCT/EP2008/010159 and German Patent Application 10 2008 005 608.1, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/010159 and DE 10 2008 005 608.1 from which this patent application claims priority which do not have to do with the correction of the translation in this patent application are not to be included in this patent application in the incorporation by reference.

Any statements about admissions of prior art in the original foreign patent applications PCT/EP2008/010159 and DE 10 2008 005 608.1 are not to be included in this patent application in the incorporation by reference, since the laws relating to prior art in non-U.S. Patent Offices and courts may be substantially different from the Patent Laws of the United States.

All of the references and documents cited in any of the documents cited herein, except for the exceptions indicated herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A packaging arrangement for packaging packages comprising:

a grouping arrangement configured to group packages;

a movement arrangement configured to move packages into said grouping arrangement;

a filling arrangement configured to move grouped packages into a container;

said grouping arrangement comprising:

a polygonal receptacle configured to receive packages; and a flexible support band configured to rotatably support said receptacle thereon;

said receptacle comprising at least a first open side and a second open side;

said band being configured to support said receptacle such that at least said first open side is covered by said band, and said second open side is uncovered and oriented to permit movement of packages therethrough and into said receptacle, wherein the packages are prevented by said band from falling out of said receptacle through said first, covered, open side; and said band being configured to rotate said receptacle such that either said first open side, covered by said band, or an additional open side, covered by said band, is uncovered and oriented to permit movement of at least one additional package therethrough and into said receptacle.

2. The packaging arrangement according to claim 1, wherein said grouping arrangement comprises a roller arrangement configured to roll up and unroll the ends of said band on storage rolls to thereby adjust the length and positioning of said band and rotate said receptacle.

3. The packaging arrangement according to claim 2, wherein said receptacle comprises a frame, cage, or partial cage comprising bars or beams.

4. The packaging arrangement according to claim 3, wherein said band is secured on its ends outside said receptacle.

5. The packaging arrangement according to claim 4, wherein said roller arrangement comprises at least one tensioning device or band guidance device disposed to engage at least one end of said band.

6. The packaging arrangement according to claim 5, wherein said roller arrangement is configured to roll up and unroll said ends of said band to thereby move said band back and forth simultaneously with the rotational movement of said receptacle.

7. The packaging arrangement according to claim 6, wherein said roller arrangement comprises at least one guide roller to guide said band during rolling and unrolling.

8. The packaging arrangement according to claim 7, wherein said roller arrangement comprises a motor configured to drive said at least one guide roller so that said band can be bent around said at least one guide roller at a substantially right angle.

9. The packaging arrangement according to claim 8, wherein:

said grouping arrangement comprises a rotation arrangement configured to assist in the rotation of said receptacle;

said rotation arrangement comprises a rotatable body and at least one drive configure to move said body along a path of rotation; and said rotatable body is either fastened to or operably connected to said receptacle to assist in the rotation of said receptacle.

10. The packaging arrangement according to claim 9, wherein:

said receptacle is variable in size in at least one direction; and each of said sides of said receptacle is an open side.

11. The packaging arrangement according to claim 9, wherein:

said receptacle is variable in size in at least one direction;

two of said sides of said receptacle, joined along a common edge, are closed sides covered by wall structures; and said wall structures are expandable wall structures comprising slats or overlapping layers.

12. A method of packaging packages using a packaging arrangement, said method comprising the steps of:

moving packages into a grouping arrangement using a movement arrangement;

grouping packages using said grouping arrangement;

moving grouped packages into a container using a filling arrangement;

said step of grouping packages comprising:

supporting and positioning a polygonal receptacle on a flexible support band, which said receptacle comprises at least a first open side and a second open side, such that at least said first open side is covered by said band, and said second open side is uncovered and oriented to permit movement of packages therethrough and into said receptacle;

moving packages into said receptacle through said second open side while preventing the packages, using said band, from falling out of said receptacle through said first, covered, open side;

rotating said receptacle by moving said band such that either said first open side, covered by said band, or an additional open side, covered by said band, is uncovered and oriented to permit movement of at least one additional package therethrough and into said receptacle; and moving at least one additional package through said first open side or an additional open side and into said receptacle.

13. The method according to claim 12, wherein said step of rotating said receptacle comprises:

rotating said receptacle over a predetermined angle of rotation; and either rotating said receptacle back over said predetermined angle of rotation, or rotating said receptacle further over an additional angle of rotation.

14. The method according to claim 13, wherein said step of rotating said receptacle comprises adjusting the tension of said band.

15. The method according to claim 14, wherein said step of rotating said receptacle comprises moving said band at a speed such that there is minimal speed differential between said band and the portions of said receptacle in contact with said band.

* * * * *